United States Patent [19]

Igi et al.

[11] Patent Number: 4,687,352

[45] Date of Patent: Aug. 18, 1987

[54] PRINTER WITH AN IMAGE READER

[75] Inventors: Hisashi Igi, Nagoya; Eiichi Ohta, Handa; Yasuhito Bandai; Kazuhiko Takagi, both of Nagoya, all of Japan

[73] Assignee: Brother Kogyo Kabushiki Kaisha, Japan

[21] Appl. No.: 813,510

[22] Filed: Dec. 26, 1985

[30] Foreign Application Priority Data

Dec. 29, 1984 [JP] Japan ..... 59-199957[U]
Dec. 29, 1984 [JP] Japan ..... 59-199958[U]
Dec. 29, 1984 [JP] Japan ..... 59-199960[U]

[51] Int. Cl.[4] ..... B41J 3/44

[52] U.S. Cl. ..... 400/73; 250/234; 250/566; 250/235; 382/57; 382/67

[58] Field of Search ..... 400/73, 59, 103–106; 250/566, 234–236; 382/57, 61, 67; 358/285

[56] References Cited

U.S. PATENT DOCUMENTS

| | | | |
|---|---|---|---|
| 3,726,381 | 4/1973 | Murphy | 400/208 X |
| 3,803,388 | 4/1974 | Williamson | 400/73 X |
| 4,039,069 | 8/1977 | Kwan | 400/73 X |
| 4,134,695 | 1/1979 | Randolph | 400/59 X |
| 4,589,143 | 5/1986 | Baur | 400/73 X |

*Primary Examiner*—Paul T. Sewell
*Attorney, Agent, or Firm*—Parkhurst & Oliff

[57] ABSTRACT

A printing apparatus comprising: an elongate platen; a guide member extending parallel to the platen; a carriage slidably movable on the guide member; a printing head mounted on the carriage; an image reading device including an image-reading portion for reading images on a recording medium on the platen, the image-reading portion being movable between a reading position adjacent to the recording medium, and a retracted position spaced from the reading position in a direction away from the recording medium; and a device for engagement of the image reading device with the carriage, to permit the image reading device to move together with the carriage. The image reading device may be supported pivotally by the guide member in the form of a rod. The carriage may have a stopper abutable on the image reading device to determine the reading position of the image-reading portion. The apparatus may further comprise a member for checking optical sensitivity of the image reading device. This checking member has a reflector which is selectively placed in an operative position opposite to the image-reading portion, and an inoperative position misaligned with the image-reading position.

15 Claims, 10 Drawing Figures

PRINTER WITH AN IMAGE READER

BACKGROUND OF THE INVENTION

1. Field of the Invention

The present invention relates to a printing apparatus with an image reading capability, having a printing head and an image reading device, which are movable along an elongate platen to effect printing and image-reading operations on a recording medium on the platen.

2. Related Art Statement

One of the inventors named in the present application collaborated with another person to develop an image reading apparatus which is disclosed in U.S. patent application Ser. No. 726,314 which was filed Apr. 24, 1985 and was owned by the assignee of the present application at the time the present invention was made. Further, two inventors of the inventors named in the present application collaborated with two other persons to develop an another image reading apparatus which is disclosed in U.S. patent application Ser. No. 768,107 which was filed Aug. 21, 1985 and was owned by the assignee of the present application at the time the present invention was made. Such image readers comprise an elongate platen, an elongate guide member extending parallel to the elongate platen, a carriage movable on the guide member, and an image reading device which is mounted on the carriage and is adapted to read iamges recorded on a recording medium in the form of sheet of paper on the platen. In such image readers which have a relatively small image-reading portion, the images in a desired portion of the sheet of paper may be read by moving the image reading device relative to the recording medium.

The above-identified U.S. application Ser. No. 768,107 discloses, as a preferred form of a printing apparatus, a printer equipped with such an image reading device as indicated above, wherein the printing head and the image reading device are constructed as a unit mounted on a common carriage. In this arrangement, it is possible to use a common platen and a common drive device for the printing head and the image reading device. Thus, a printer with an image reading device is available in simple construction and at a relatively reduced cost.

In such a printer with an image reader in which the image reading device and the printing head are constructed as a unit, however, the image-reading portion of the image reading device is located close or adjacent to the recording medium even while the printing head is operating at its printing position adjacent to the recording medium. Consequently, the image-reading portion may interfere with an ink ribbon for the printing head, or may be subject to contamination due to exposure to fine particles removed from the ink ribbon or the recording medium. In the meantime, it is desired that the image-reading portion of the image reader and the printing head cover the same area on the recording medium. Simultaneously, it is a desire to reduce the size of the printer-image reader combination by minimizing the operating stroke of the carriage. To satisfy these two desires, it is preferred to construct the printer-reader apparatus such that the printing head and the image-reading portion are disposed as close as possible to each other. In this instance, however, the area of the recording medium in which the printing or image reading is being effected is broadly covered by the printing head and the image reading device, whereby it is difficult to visually check the currently printed or read area. The inventors of the present application recognized the foregoing inconveniences of the printer-reader apparatus indicated above.

SUMMARY OF THE INVENTION

It is therefore an object of the present invention to provide a printing apparatus with an image reading function, having a printing head and an image reading device movable by a common driving device along a platen, and wherein the image reading device has an image-reading portion which is movable between a reading position adjacent to a recording medium on the platen, and a retracted position which is spaced away from the reading position in a direction away from the reading position.

Another object of the invention is the provision of such a printing apparatus wherein an arrangement for moving the image-reading portion between its reading and retracted positions is simple in construction and economical to manufacture.

A further object of the present invention is to provide such a printing apparatus wherein the image-reading portion and the printing head may be assembled with ease and precisely positioned relative to each other.

A still further object of the invention is to provide such a printing apparatus wherein a clearance or gap between the image-reading portion of the image reading device and the surface of the recording medium may be held at a suitable amount, without a spacer interposed between the recording medium and the image-reading portion.

An yet further object of the invention is the provision of such a printing apparatus as indicted just above, wherein the clearance between the image-reading portion and the recording medium may be easily adjusted.

Another object of this invention is to provide such a printing apparatus which is equipped with a checking device having a reflector surface for checking the image reading device for its optical sensitivity, and wherein the reflector surface is movable between its operative and inoperative positions, in response to movements of the image-reading portion to the reading and retracted positions.

A further object of the invention is to provide such a printing apparatus as indicated just above, which has means for protecting the reflector surface of the checking device from contamination.

Yet another object of the present invention is the provision of such a printing apparatus, which has means for automatically cleaning the reflector surface of the checking device while the reflector surface is moved between its operative and inoperative positions.

According to the present invention, there is provided a printing apparatus with an image reading function, comprising: (a) an elongate platen extending for supporting a recording medium; (b) an elongate guide member extending parallel to the platen; (c) a carriage slidably movable on the guide member; (d) a printing head mounted on the carriage; (e) an image reading device including an image-reading portion for reading images on the recording medium on the platen, the image-reading portion being movable between a reading position adjacent to the recording medium, and a retracted position spaced from the reading position in a direction away from the recording medium; and (f)

connecting means for engagement of the image reading device with the carriage, to permit the image reading device to move together with the carriage.

In the printing apparatus of the present invention constructed as described above, the printing head and the image reading device are movable as a unit along the guide member, while at the same time the image-reading portion of the image reading device is movable, relative to the printing head, between its reading and retracted positions. In this arrangement, the image-reading portion is protected against contamination due to fine particles which may be removed from an ink ribbon and/or a recording medium during a printing operation by the printing head. In addition, the above arrangement facilitates a visual checking of a printing area on the recording medium, because the image-reading portion is held retracted away from the recording medium during a printing operation.

According to one advantageous embodiment of the invention, the elongate guide member comprises a guide rod having a circular shape in transverse cross section, and the image reading device is supported by the guide rod pivotally about an axis of the guide rod. The image-reading portion of the image reading device is provided at a position away from the axis of the guide rod, and is moved between the reading and retracted positions through pivotal movements of the image reading device about the axis of the guide rod.

In the above embodiment, the image reading device and the carriage carrying the printing head are both supported on a common guide rod, such that the image-reading portion is pivotable about the axis of the guide rod. This arrangement permits easy assembling of the carriage and the image reading device, and assures accurate positioning of the printing head and the image-reading portion relative to each other, and to the platen.

In one form of the above embodiment, an ink ribbon is passed along the platen and between the printing head and the recording medium so that the printing head effects a printing operation on the recording medium through the ink ribbon. The image-reading portion of the image reading device is located away from a part of the recording medium corresponding to a path of the ink ribbon.

According to another advantageous embodiment of the invention, the carriage has a stopper which is abutable on the image reading device, to thereby determine the reading position of the image-reading portion. This embodiment makes it possible to maintain a suitable gap or clearance between the image-reading portion and the surface of the recording medium on the platen.

In one form of this embodiment, the stopper consists of a pin which is fixed to the carriage and which extends parallel to the guide member. The pin may comprise a shaft portion rotatably supported at one end thereof by the carriage, a head portion which is secured to the other end of the shaft portion in eccentric relation with each other and is abutable with the image-reading portion, and an operating portion for rotating the pin about an axis of the shaft portion. With the pin rotated, the reading position of the image-reading portion is adjustable by rotation of the pin. In this case, the above-indicated gap of the image-reading portion to the recording medium can be adjusted as needed by rotating the pin.

In another form of the above embodiment, the stopper consists of a lug fixed to the carriage, and the image reading device has an adjustable abutment member which is abutable on the lug to thereby determine the reading position of the image-reading portion. In this case, the adjustable abutment member may consists of an eccentric member including a first outer cylindrical surface abutable on the lug, and a second cylindrical surface eccentric with respect to the first outer cylindrical surface. The eccentric member is supported on the image reading device rotatably about a centerline of the second cylindrical surface. In this case, too, the gap between the image-reading portion and the recording medium can be adjusted by rotating the eccentric member. The second cylindrical surface may be either an outer surface or an inner surface of the eccentric member, provided the second cylindrical surface is eccentric with the first outer cylindrical surface.

In the case where the adjustable abutment member consists of the eccentric member indicated above, the image reading device may have a serrated part, and the eccentric member has an operating portion extending in a radial direction thereof. The operating portion of the eccentric member resiliently engages the serrated part of the image reading device, so as to prevent a free rotation of the eccentric member. In this instance, the operating portion serves for maintaining the predetermined reading position of the image-reading portion, as well as for rotating the eccentric member for adjusting the reading position.

According to a further advantageous embodiment of the present invention, the elongate platen includes a paper support portion for supporting the recording medium, and the printing apparatus further comprises an optical-sensitivity checking member for checking the image reading device for its optical sensitivity, and a linkage for operatively connecting the checking member and the image reading device to a common drive source. The checking member has a reflector surface which is located away from one of opposite longitudinal ends of the paper support portion of the platen. The checking member is movable between an operative position at which the reflector surface is positioned opposite to the image-reading portion in the reading position, and an inoperative position at which the reflector surface is misaligned with the image-reading portion in the reading position. The linkage which connects the checking member and the image reading device to the mmon drive source, causes the checking member to be moved to the operative position and the inoperative position when the image-reading portion is moved by the common drive source to the reading position and the retracted position, respectively.

In the above embodiment, the optical sensitivity of the image reading device can be checked prior to an image reading operation. When the image-reading portion is moved to its reading position by the drive source through the linkage, the checking member is automatically moved, by the same drive source through the linkage, to its operative position at which the reflector surface is aligned with a path of the image-reading portion. Further, the linkage permits the checking member to be retracted to its inoperative position when the image-reading portion is retracted. This arrangement for retracting the checking member to its inoperative position serves to protect the reflector surface from being soiled during a printing operation by the printing head. Furthermore, the use of a single drive source for synchronized movements of the image reading device and the checking member makes it possible to simplify the overall construction of the printing apparatus and reduce its cost of manufacture.

In one form of the above embodiment, the printing apparatus further comprises a stationary covering member for covering the reflector surface of the checking member in the inoperative position. The covering member may have a wiper disposed on a surface thereof opposite to the reflector surface, to clean the reflector surface during movements of the checking member between the operative and inoperative positions.

In another form of the above embodiment, the elongate guide member comprises a guide rod having a circular shape in transverse cross section, and the image reading device is supported by the guide rod pivotally about an axis of the guide rod. The elongate platen further includes a shaft portion at which the plate is rotatably supported, and the checking member is supported by the shaft portion of the platen pivotally about the shaft portion.

In the above form of the printing apparatus, the linkage may be adapted to comprise an actuator member, a connecting rod for operatively connecting the actuator member and the checking member, a pivot arm which is pivoted by the common drive source within a predetermined angular range about an axis parallel to the axis of the guide rod, and biasing means. The actuator member includes an elongate operating portion which extends along the guide rod, and a pair of support portions which extend from opposite ends of the operating portion substantially perpendicularly to the operating portion. The actuator member is supported at the support portions thereof by the guide rod pivotally about the guide rod. The elongate operating portion slidably engages the image reading device so as to permit the image reading device to move relative to the operating portion along the guide rod. The connecting rod is movable between a first position at which the image-reading portion of the image reading device and the checking member are placed in the reading and operative positions, respectively, and a second position at which the image-reading portion and the checking member are placed in the retracted and inoperative positions, respectively. The pivot arm has a free end which engages the connecting rod with a clearance therebetween. The biasing means is adapted to bias the connecting rod toward the first and second positions when the connecting rod have been pivoted, by the pivot arm, to positions near the first and second positions, respectively, whereby the image-reading portion and the checking member are biased by the biasing means toward the reading and operative positions, and toward the retracted and inoperative positions, respectively.

Alternatively, the linkage may be adapted to comprises the above-described actuator member, a first spring, a second spring, a connecting rod, and means for transmitting a drive force of the drive source to the checking member to move the checking member between its operative and inoperative positions. The first spring biases the actuator member toward a first position thereof corresponding to the image reading position of the image-reading portion. The second spring provides a biasing force greater than that of the first spring. The connecting rod is operatively connected to the actuator member so as to exert the biasing force of the second spring to the actuator member to normally hold the actuator member in a second position thereof corresponding to the retracted position of the image-reading portion, against the biasing force of the first spring. The connecting rod is operatively connected to the checking member so that the movement of the checking member from its inoperative position to its operative position is imparted to the connecting rod to move the connecting rod against the biasing force of the second spring, and to thereby allow the actuator member to be moved from its second position to its first position by the biasing force of the first spring.

According to another aspect of the invention, there is also provided an image reading apparatus which comprises: an alongate platen including a paper support portion for supporting a recording medium; an elongate guide member extending parallel to the platen; a carriage slidably movable on the guide member; an image reading device including an image-reading portion for reading images on the recording medium on the platen, the image-reading portion being movable between a reading position adjacent to the recording medium, and a retracted position spaced from the reading position in a direction away from the recording medium; connecting means for engagement of the image reading device with the carriage, to permit the image reading device to move together with the carriage; an optical-sensitivity checking member for checking the image reading device for its optical sensitivity; and a linkage for operatively connecting the checking member and the image reading device to a common drive source. The checking member has a reflector surface which is located away from one of opposite longitudinal ends of the paper support portion of the elongate platen. The checking member is movable between its operative and inoperative positions. In the operative position, the reflector surface is positioned opposite to the image-reading portion placed in its reading position. In the inoperative position, the reflector surface is misaligned with the image-reading portion placed in its reading position. The linkage is constructed to cause the checking member to be moved to the operative and inoperative positions when the image-reading portion of the image reading device is moved by the common drive source to the reading and retracted positions, respectively.

BRIEF DESCRIPTION OF THE DRAWING

The above and other objects, features and advantages of the present invention will become more apparent from reading the following detailed description of a preferred embodiment of the invention, when considered in connection with the accompanying drawing, in which.

DETAILED DESCRIPTION OF THE PREFERRED EMBODIMENT

For the purpose of illustration, there will be described in detail preferred embodiments of a printing apparatus with an image reading device suitable for implementing the concept of the present invention, referring to the accompanying drawing.

Figure 1:
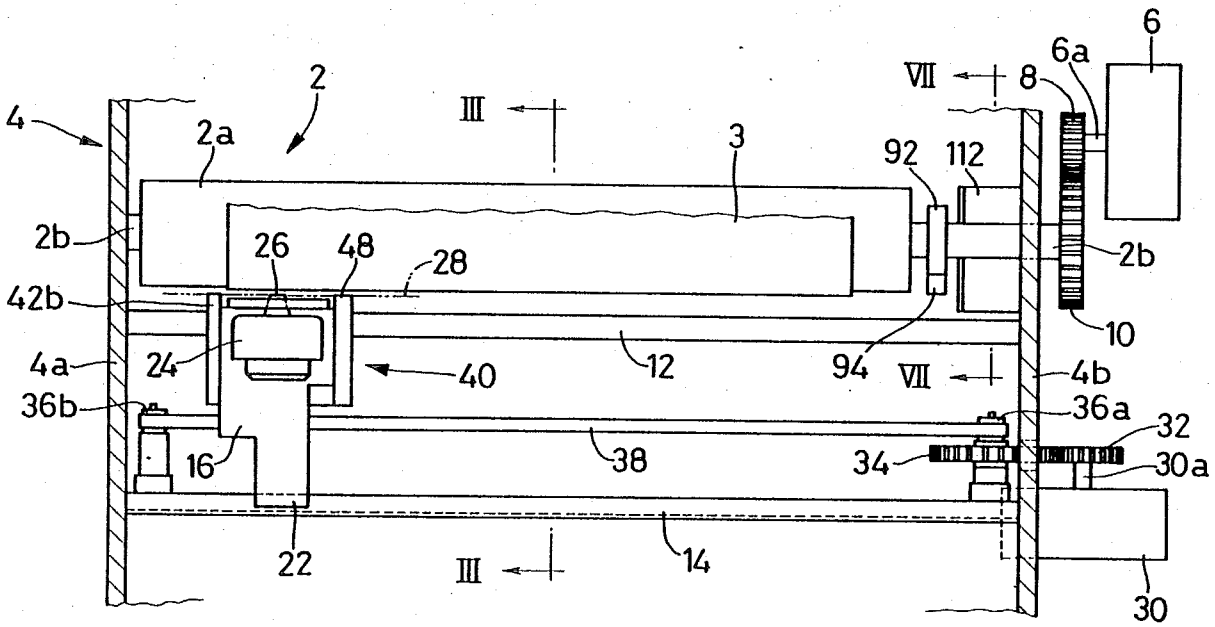
FIG. 1 is a fragmentary plan view of one embodiment of a printing apparatus with an image reading device of the present invention.

There is shown in FIGS. 1–7 a structural arrangement of the printing apparatus, wherein a generally elongate platen 2 has a paper support portion 2*a* for supporting a recording medium in the form of a sheet of paper 3, as shown in FIG. 1. The platen 2 further has shaft portions 2*b* connected to opposite longitudinal ends of the paper support portion 2*a*. The platen 2 extends along a line of printing to be effected on the sheet of paper 3, and is rotatably supported at their shaft portions 2*b* by a pair of side walls 4*a*, 4*b* of a frame 4 of the printing apparatus. The platen 2 is rotated about its axis by a paper feed drive motor 6 via an output shaft 6*a* of the motor 6, a first gear 8 connected to the output shaft 6*a*, and a second gear 10 which is connected to the end of one of the bearing shaft portions 2*a* of the platen 2 and which meshes with the first gear 8. With the drive motor 6 operated in one of opposite directions, the sheet of paper 3 on the platen 2 is fed in the corresponding direction across the line of printing. In front of the platen 2, there are disposed a guide rod 12 and a guide rail 14 which are supported by the pair of side walls 4*a*, 4*b*, so as to extend parallel to the platen 2. The guide rod 12 has a circular shape in transverse cross section and serves as a guide member, as described later in detail.

Figure 2:
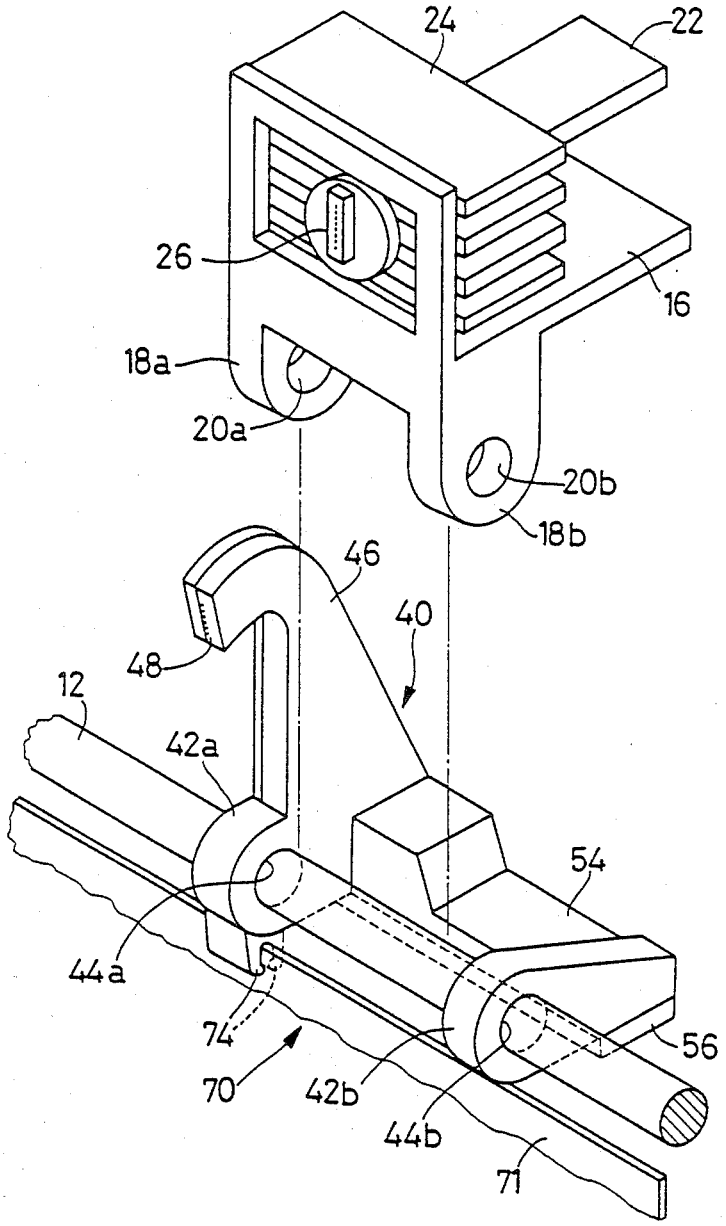
FIG. 2 is a fragmentary exploded view in perspective of the printing apparatus of FIG. 1.
Figure 3:
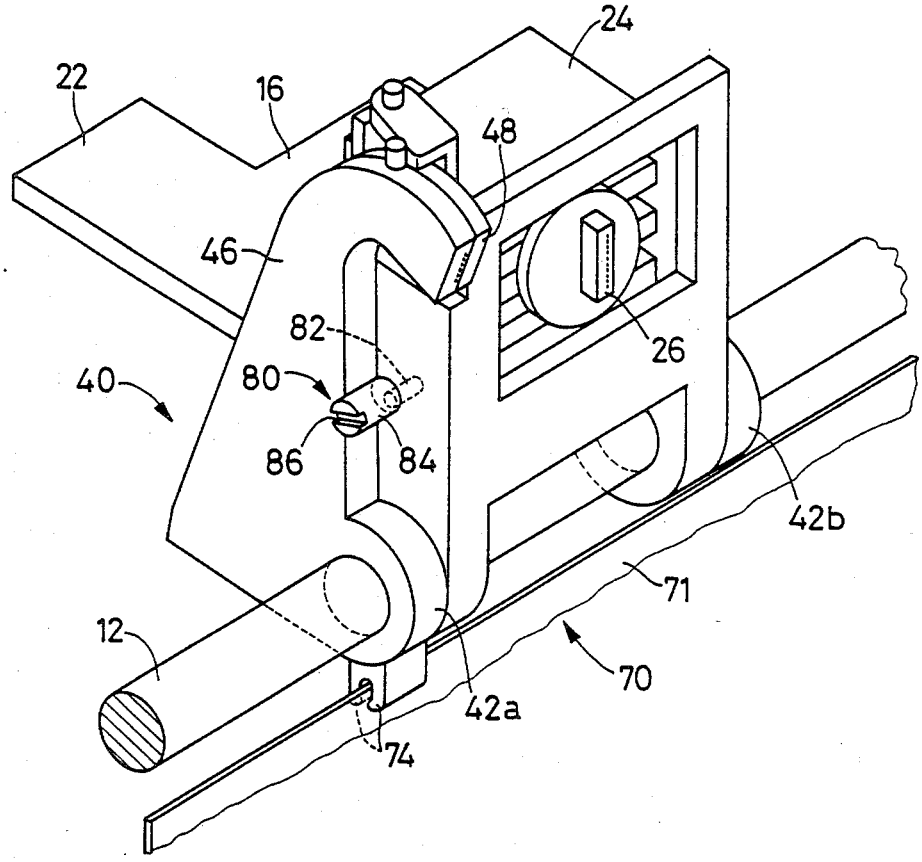
FIG. 3 is a fragmentary perspective view of the printing apparatus of FIG. 1, taken in a direction different from that of FIG. 2.
Figure 7:
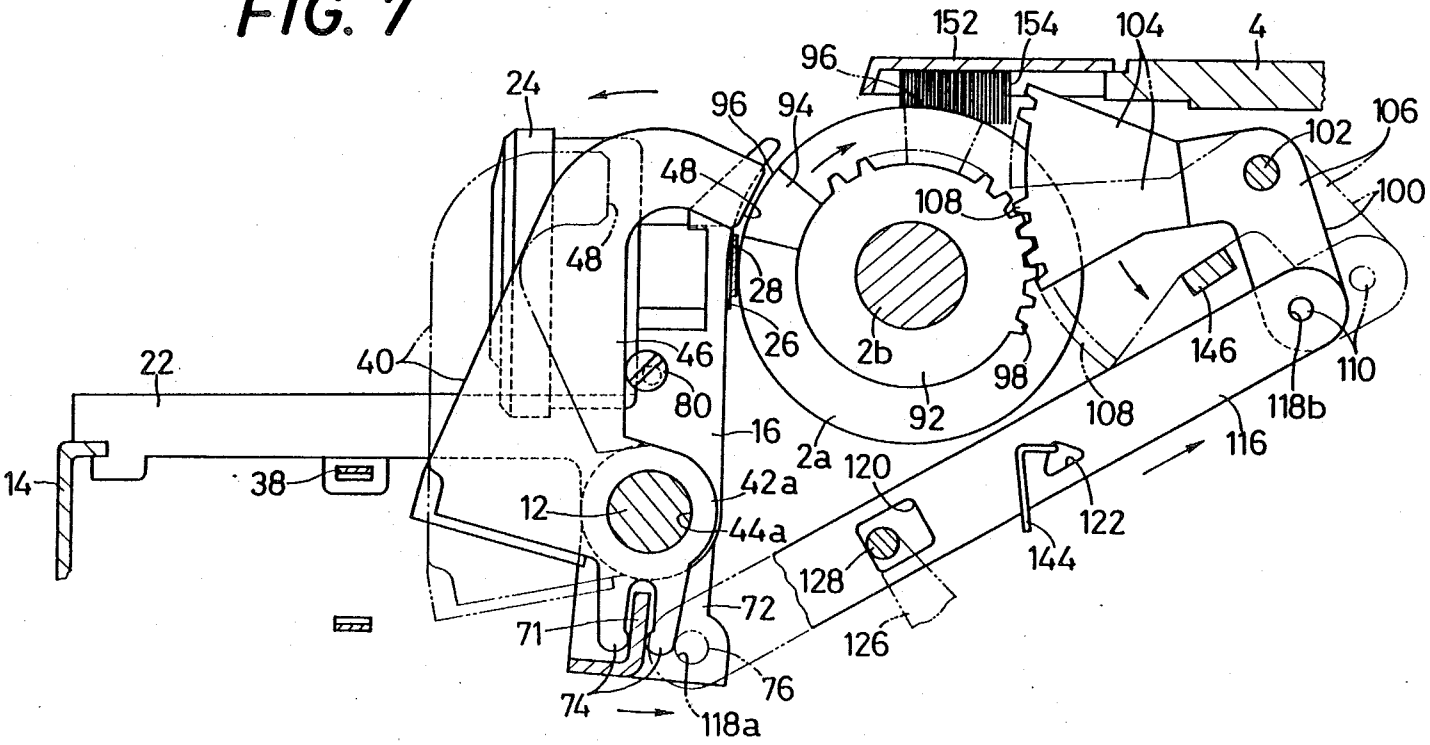
FIG. 7 is a side elevational view in cross section taken along line VII—VII of FIG. 1.

As most clearly shown in FIGS. 2 and 3, a carriage 16 is formed with a pair of support portions 18*a*, 18*b* which are spaced apart from each other by a suitable distance along the guide rod 12. The support portions 18*a*, 18*b* have bores 20*a*, 20*b*, respectively, which slidably engage the guide rod 12. Thus, the carriage 16 is slidably supported by the guide rod 12. The carriage 16 is further provided with a plate-like front extension 22 which slidably engage the guide rail 14, as shown in FIGS. 1 and 7. On the carriage 16, there is fixedly mounted a printing head 24 having a printing portion 26. With the carriage 16 slidably supported on the guide rod 12 and guide rail 14, the printing portion 26 is positioned adjacent and opposite to the circumferential surface of the platen 2, as indicted in FIG. 3. Between the printing portion 26 and the surface of the platen 2, an active portion of an ink ribbon 28 is passed, so that a desired printing is effected by means of an ink on the ink ribbon 28. The ink ribbon 28 is supplied from a ribbon cassette (not shown) supported on the frame 4 in a known manner.

The carriage 16 is slidably moved on the guide rod 12 and the guide rail 14 along the platen 2, by a carriage drive motor 30, via an output shaft 30*a* of the motor 30, a third gear 32 connected to the output shaft 30*a*, a fourth gear 34 which meshes with the third gear 32, a first pulley 36*a* which is supported adjacent to the side wall 4*b*, rotatably with the fourth gear 34, and a timing belt 38 which connects the first pulley 36*a* and a second pulley 36*b* which is rotatably supported adjacent to the side wall 4*a*. The timing belt 38 is fixed to the carriage 16, so that a rotary motion of the drive motor 30 is imparted to the carriage 16. A printing operation on the sheet of paper 3 on the platen 2 is effected at the printing portion 26 through the ink ribbon 28 while the printing head 24 on the carriage 16 is moved along the platen 2.

The guide rod 12 also supports an image reading device 40 comprising a pair of support portions 42*a*, 42*b* each of which has a bore 44*a*, 44*b*, as most clearly shown in FIG. 2. The support portions 42*a*, 42*b* are spaced apart from each other by a suitable distance along the guide rod 12, and slidably engage the guide rod 12 at their bores 44*a*, 44*b* such that the carriage 16 is sandwiched between the support portions 42*a*, 42*b* in a direction along the guide rod 12, as most clearly shown in FIG. 3. The distance between the support portions 42*a*, 42*b* is selected so that the support portions 20*a*, 20*b* of the carriage 16 are located adjacent to the corresponding support portions 42*a*, 42*b*. Thus, the carriage 16 and the image reading device 40 are slidably movable as a unit on the guide rod 12. Further, the image reading device 40 is pivotable about an axis of the guide rod 12, relative to the carriage 16, as described later in detail.

Figure 4:
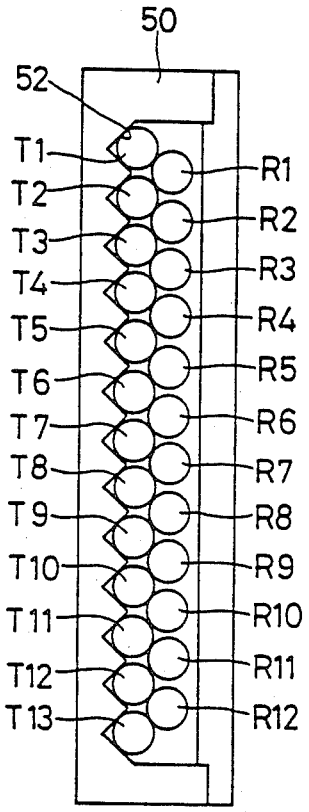
FIG. 4 is an enlarged view showing reading ends of two rows of optical fibers retained at an image-reading portion of the image reading device.

The image reading device 40 further comprises an arm portion 46 which extends from the support portion 42*a*, in an upward direction away from the axis of the guide rod 12. The arm portion 46 terminates at its distal end into an image-reading portion 48, at which first ends of light-emitting optical fibers T1–T13 and light-receiving optical fibers R1–R12 are retained in two parallel rows adjacent to each other, as shown in FIG. 4 and as described later in detail. Thus, the image-reading portion 48 is supported by the arm portion 46 immovably relative to the support portion 42*a* from which the arm portion 46 extends. With the image reading device 40 pivotally supported by the guide rod 12, the image-reading portion 48 is pivotable between its reading position adjacent to the surface of the platen 2, above a path of the active portion of the ink ribbon 28, as indicated in FIG. 7 in solid line, and its retracted position which is away from the reading position in a direction away from the surface of the platen 2, as indicated in FIG. 7 phantom line.

As indicated above, the optical fibers T1–T13 and R1–R12 are disposed at their first ends in two parallel rows at the image-reading portion 48. As shown in FIG. 4, the image-reading portion 48 has a fiber holder plate 50 which has a serrated surface with a series of projections which define thirteen grooves 52 that are equally spaced from each other in the direction in which the two rows of the optical fibers T1–T13 and R1–R12 extend. The first ends of the light-emitting optical fibers T1–T13 are held in engagement with the corresponding grooves 52. In the meantime, the first ends of the light-receiving optical fibers R1–R12 are held in contact with the first ends of the adjacent light-emitting optical fibers T1–T13, such that the first ends of the optical fibers R1–R12 are displaced relative to the first ends of the optical fibers T1–T13 along the rows of the optical fibers, by a distance equal to a half of the pitch in which the first ends of the optical fibers T1–T13 are disposed.

Figure 5:
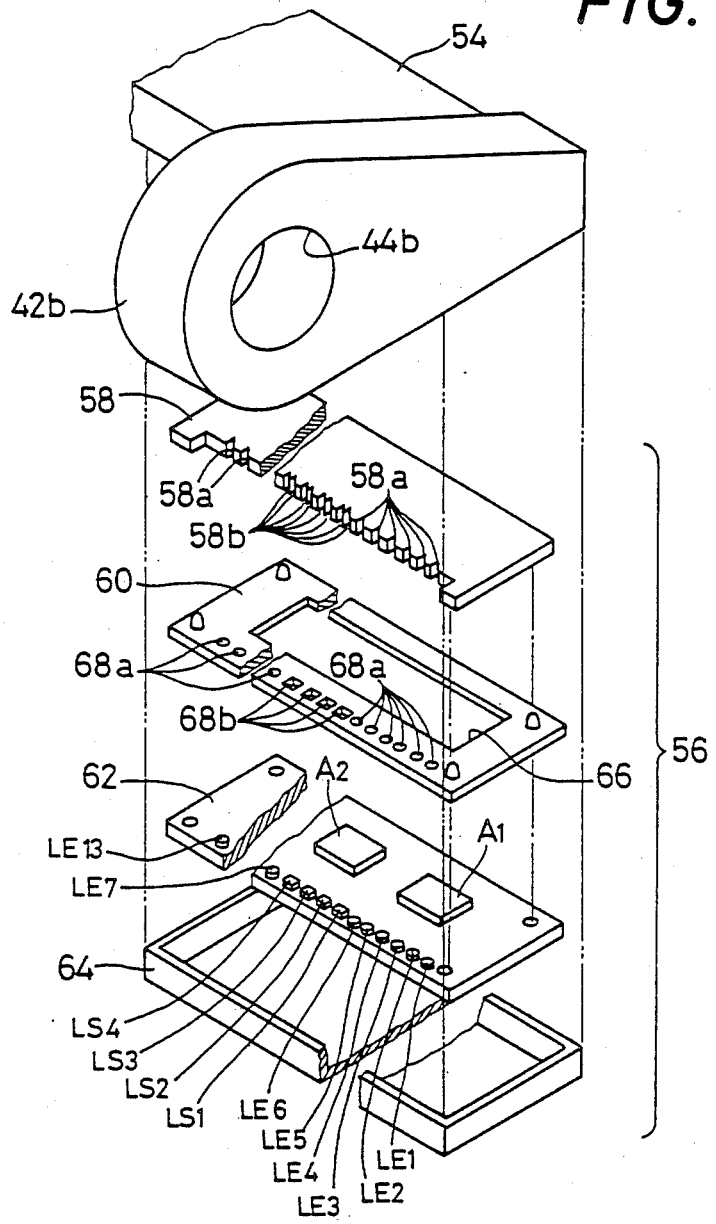
FIG. 5 is a fragmentary exploded perspective view of an arrangement of a control circuit incorporated in a bridging portion of the image reading device.

The image reading device 40 further comprises a bridging portion 54 which extends below the carriage 16, parallel to the guide rod 12, so as to connect the pair of support portions 42*a*, 42*b* so that the support portions 42*a*, 42*b* are not movable relative to each other. The bridging portion 54 houses an image-reading control assembly 56 as illustrated in FIG. 5. The control assembly 56 includes a retainer plate 58, a shielding plate 60, a printed-wiring board 62, and a bottom casing 64. The retainer plate 58 has thirteen grooves 58*a* for holding the second ends of the thirteen light-emitting optical fibers T1–T13, and eight grooves 58*b* for holding the second ends of the light-receiving optical fibers R1–R12. The eight light-receiving optical fibers, for example, R1–R4 and R7–10, are held in direct engagement with the eight grooves 58*b*, and the remaining four light-receiving optical fibers R5, R6, R11 and R12 are held in contact with the appropriate adjacent two optical fibers R1 and R3, R2 and R4, R7 and R9, and R8 and R10, respectively. Thus, the optical fibers R1, R3 and R5 constitute a first group, the optical fibers R2, R4 and R6 a second group, the optical fibers R7, R9 and R11 a third group, and the optical fibers R8, R10 and R12 a fourth group.

The shielding plate 60 is disposed below the retainer plate 58, and has an elongate rectangular opening 66, and further has thirteen round holes 68*a* alighed with the second ends of the light-transmitting optical fibers T1–T13, and four square holes 68*b* alighed with the second ends of the four groups of the optical fibers R1–R12, respectively. The printed wiring board 62, which is disposed below the shielding plate 60, is adapted to hold four amplifiers A1–A4 (only A1 and A2 shown), thirteen light-emitting elements LE1–LE13, and four light-sensitive elements LS1–LS4. The amplifiers A1–A4 are accommodated in the rectangular opening 66 formed in the shielding plate 60. The light-emitting elements LE1–LE13 are positioned so that second ends of the light-emitting optical fibers T1–T13 are located opposite to the elements LE1–LE13, respectively, in order to receive beams of light emitted by these elements LE1–LE13. The light-sensitive element LS1 is positioned opposite to the second ends of the first group of light-receiving optical fibers R1, R3 and R5, so that the element LS1 receive beams of light transmitted through these optical fibers. In the same way, the light-sensitive elements LS2–LS4 are positioned opposite to the second ends of the second, third and fourth groups of light-receiving optical fibers R2, R4 and R6; R7, R9 and R11; and R8, R10 and R12. The bottom casing 64 cooperates with the bridging portion 54 to accommodate the retainer plate 58, shielding plate 60 and printed wiring board 62 which are superposed on each other.

Referring back to FIGS. 2 and 3 and further to FIGS. 6 and 7, an actuator member 70 is disposed below the guide rod 12. The actuator member 70 comprises an elongate operating portion 71 extending parallel to the guide rod 12, and a pair of support portions 72 (FIGS. 6 and 7) which extend from opposite longitudinal ends of the operating portion 71 substantially perpendicularly to the operating portion 71. The actuator member 70 is supported at its support portions 72 by the corresponding opposite ends of the guide rod 12, pivotally about the axis of the guide rod 12. The support portion 42*a* of the image reading device 40 from which the arm portion 46 extends, is formed with a bifurcated engagement portion 74 which slidably engage the operating portion 71 of the actuator member 70 so as to sandwich the same. The actuator member 70 is pivotally operated between two positions by a drive motor 75 via a linkage (which will be described) which is connected to a pin 76 extending from one of the support portions 72 parallel to the guide rod 12. With the actuator member 70 operated between its two positions, the image-reading portion 48 is moved between its reading position shown in solid line in FIG. 7, and its retracted position shown in phantom line in the same figure, as previously described.

The carriage 16 has, on its right-hand side surface, a stopper in the form of a pin generally indicated at 80 in FIG. 3. This stopper pin 80 extends from the right-hand side surface of the carriage 16, so that it is abutable on the image reading device 40, to determine the reading position of the image-reading portion 48. The pin 80 is eccentrically rotatable so as to adjust its stop position, that is, the reading position of the image-reading portion 48. More specifically, the stopper pin 80 comprises: a shaft portion 82 rotatably supported at its one end in the side surface of the carriage 16; a head portion 84 which is secured to the other end of the shaft portion 82 is eccentric relation with each other, and an operating portion in the form of a groove 86 formed in one end of the head portion 84 remote from the shaft portion 82. The shaft portion 82 is relatively tightly fitted in a hole formed in the side surface of the carriage 16. The groove 86 of the operating portion is engageable with the tip of a screw driver. With a suitable screw driver engaging the groove 86, the stopper pin 80 may be rotated with its operating portion 84 rotating about the axis of the shaft portion 82.

The stopper pin 80 is positioned so that the outer circumferential surface of its head portion 84 is abutable on the arm portion 46 of the image reading device 40 when placed in its reading position, as shown in FIG. 7. Thus, the stopper pin 80 stops the image reading device 40 at its reading position. Thus, a clearance or gap between the image-reading portion 48 in its reading position, and the surface of the platen 2, may be held at a predetermined value, depending upon the circumferential or angular position of the stopper pin 80 with respect to the carriage 16. Namely, the reading position of the image-reading portion 48 or its clearance to the platen 2 is adjustable by rotating the stopper pin 80 with a screw driver engaging the groove 86.

The right shaft portion 2*b* of the platen 2 carries an optical-sensitivity checking member 90 fitted thereon pivotally about its axis, i.e., about the axis of the platen 2. The checking member 90 includes an annular portion 92 slidably fitting on the shaft portion 2*a*, and a radial projection 94 which protrudes radially from a part of the outer circumferential surface of the annular portion 92. The radiall projection 94 has a reflector surface 96 having a predetermined reflectance of light which is used as a reference for checking the image reading device 40 for its optical sensitivity. The annular portion 92 has a plurality of teeth 98 on another part of its outer circumferential surface. A pivotable member 100 is disposed adjacent to and in the rear of the checking member 90, and is housed within the frame 4. The pivotable member 100 is supported pivotally about a pivot pin 102, and includes a first arm 104 and a second arm 106 which extend from the pivot pin 102. The first arm 104 has teeth 108 which mesh with the teeth 98 formed on the annular portion 92 of the checking member 90. The second arm 106 has a pin 110 fixed thereto. With the pivotable member 100 pivoted in clockwise and counterclockwise directions by means of its pin 110, the checking member 90 is rotated through engagement of its teeth 98 with the teeth 108, between its operative position and its inoperative position. In the operative position, the reflector surface 96 is positioned opposite to a path of the image-reading portion 48 placed in the reading position, as indicated in solid line in FIG. 7. The inoperative position is spaced rearwardly of the operative position in the circumferential direction of the annular portion 92. Namely, the reflector surface 96 is misaligned with the image-reading portion 48 when the checking number 90 is placed in its inoperative position, as indicated in phantom line in FIG. 7.

To the inner surface of the right side wall 4*b* of the frame 4, there is secured a bracket 112 which supports the previously indicated drive motor 75 which is operable in opposite directions. A power transmission system or linkage generally indicated at 114 in FIG. 6 is provided to operatively connect the drive motor 75 to the pin 76 of the actuator member 70 and to the pin 110 of the pivotable member 100. A clockwise or counterclockwise rotary motion of the drive motor 75 is transmitted to the actuator member 70 and to the pivotable member 100 via this linkage 114, and through the respective pins 76 and 110. As a result, the image-reading portion 48 of the image reading device 40 is located at its reading or retracted position, while the checking member 90 is located at its operative or inoperative position, as indicted in solid or phantom line in FIG. 7.

Described in greater detail, the linkage 114 comprises a connecting rod 116 which has a first and a second round hole 118*a*, 118*b* formed on the opposite longitudinal ends, respectively. The previously indicated pins 76 and 110 slidably fit in the corresponding first and second round holes 118*a*, 118*b*. The connecting rod 116 further has a rectangular hole 120 between the round holes 118*a*, 118*b*, and a triangular hole 122 between the rectangular hole 120 and the round hole 118*b*. In the meantime, the bracket 112 supports a shaft 124 by which is pivotally supported a pivot arm or operating lever 126 having an operating free end 128. The operating end 128 of the pivot arm 126 engages the rectangular hole 120 formed in the connecting rod 116. Between the drive motor 75 and the pivot arm 126, there is disposed a reduction gear device which comprises a plurality of gears 130, 132, 134, 136, 138 and 140. This reduction gear device converts rotary motions of the drive motor 75 into pivotal movements of the pivot arm 126, which cause the connecting rod 116 to be moved in opposite directions so as to pivot the actuator member 70 and the pivotable member 100 about the respective axes, i.e., guide rod 12 and the pivot pin 102, via the respective pins 76, 110.

A torsion coil spring 144 is disposed in engagement with the connecting rod 116 at its triangular hole 122, and with a pin 142 fixed to the bracket 112. This coil spring 144 serves as a toggle mechanism. Stated more particularly, when the connecting rod 116 has been moved by the drive motor 75 beyond a dead point in either one of the opposite directions, the biasing direction of the coil spring 144 with respect to the connecting rod 116 is reversed, whereby the connecting rod 116 is biased by the coil spring 144 so as to keep the image-reading portion 48 and the checking member 90 in the reading and operative positions, or in the retracted and inoperative positions, respectively, depending upon the direction of movement of the connecting rod 116 beyond the dead point.

The previously indicated stopper pin 80 is adapted to abut on the arm portion 46 of the image reading device 40 when the connecting rod 116 has been moved beyond the dead point of the coil spring 144, during its movement for pivotal movements of the image reading device 40 and the checking number 90 from their retracted or inoperative position to their reading or operative position. Thus, the stopper. pin 80 serves to determine the reading position of the image-reading portion 48 as well as the operative position of the checking member 90.

A stopper 146 (FIG. 7) is fixed to the frame 4, so that it is abutable on the first arm 104 of the pivotable member 100 when the connecting rod 116 has been moved beyond the dead point of the coil spring 144, during its movement for pivotal movements of the image reading device 40 and the checking member 90 from their reading or operative position to their retracted or inoperative position. Thus, the stopper 146 serves to determine the retracted or inoperative position of the image-reading portion 48 and the checking member 90.

A first and a second limit switch 148, 150 are disposed so that these limit switches 148, 150 are actuated by the corresponding opposite ends of the connecting rod 116 when the connecting rod 116 has been moved by a predetermined distance by the drive motor 75, during its movements for pivotal movements of the image reading device 40 and the checking member 90 between their reading or operative position, and their retracted or inoperative position. The drive motor 75 is stopped when the limit switch 148 or 150 is actuated.

Figure 6:
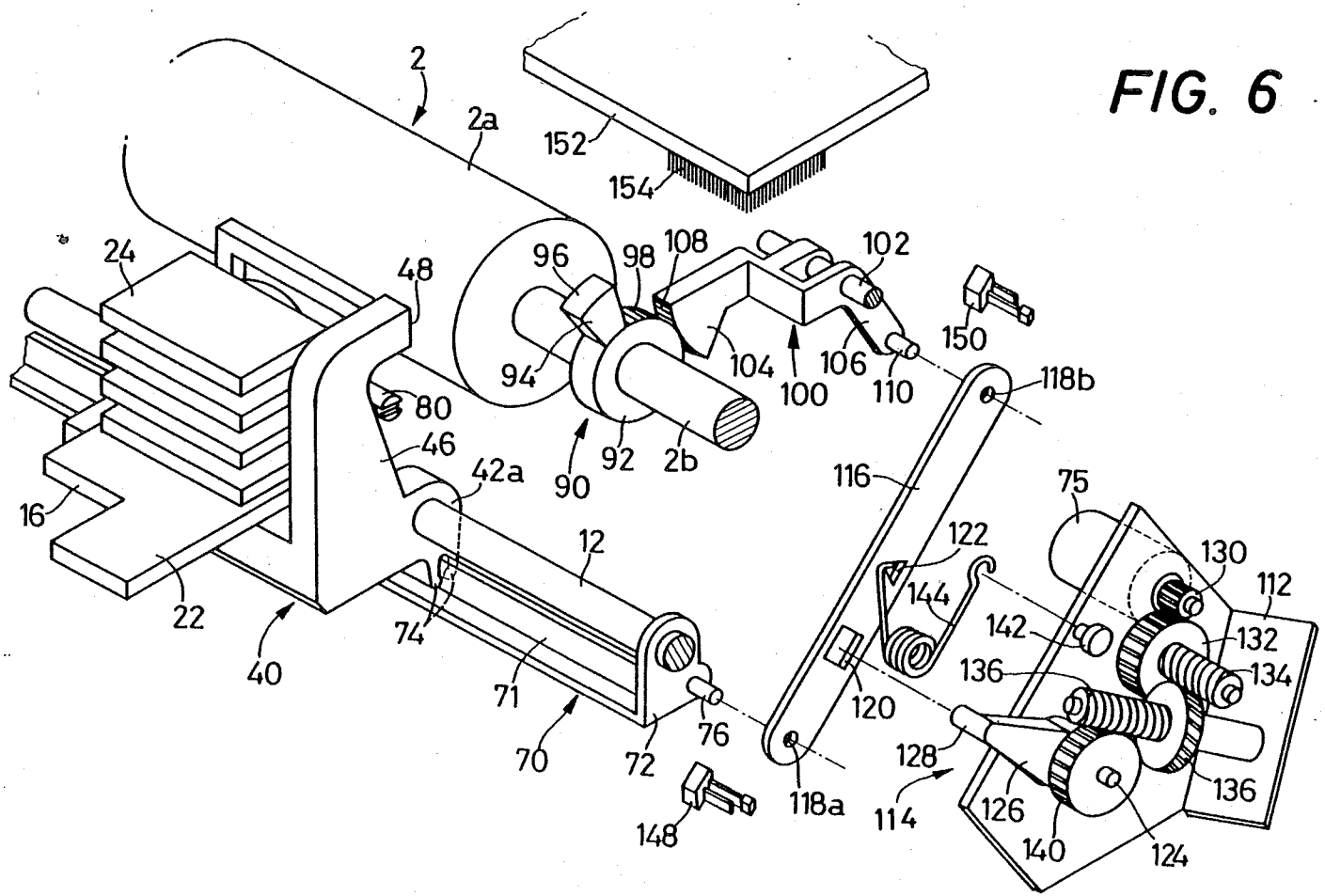
FIG. 6 is a fragmentary exploded view in perspective of the apparatus of FIG. 1, showing an arrangement for checking the image reading device for its sensitivity.

As shown in FIGS. 6 and 7, a covering member 152 is removably fixed to the frame 4, so as to cover the reflector surface 96 of the checking member 90 when placed in its inoperative position, as indicated in FIG. 7. The covering member 152 has a wiper in the form of a layer of a brush 154 attached to the inner surface. The brush 154 is arranged to be held in contact with the reflector surface 96 when the checking member 90 is in the inoperative position. In this arrangement, the reflector surface 96 is automatically cleaned or wiped with the brush 154 when the checking member 90 is pivotally moved between its operative and inoperative positions.

There will be described the operation of the printing apparatus which is constructed as described hitherto.

Prior to reading images recorded on the sheet of paper 3 on the platen 2, the optical sensitivity of the image reading device 40 is checked. Initially, the carriage 16 and the image reading device 40 are moved as a unit on the guide rod 12 in the right position (in FIGS. 1 and 6), by the drive motor 30 through the timing belt 38 and the previously described components, until the image-reading portion 48 are aligned with the checking member 90 at the right-hand side end of the platen 2. In this position, the drive motor 75 is operated in the clockwise direction. As a result, the pivot arm 126 is pivoted in the counterclockwise direction (in FIGS. 6 and 7) through the gears 130, 132, 134, 136, 138 and 140, and the operating end 128 of the pivot arm 126 is brought into contact with one of longitudinally opposed inner surfaces of the rectangular hole 120 which is nearer to the round hole 118*a*. With a further counterclockwise pivotal movement of the pivot arm 126, the connecting rod 116 is moved to cause the image reading device 11 and the checking member 90 to be pivoted clockwise and counterclockwise via the actuator member 70 and the pivotable member 100, respectively, from their retracted or inoperative position toward their reading or operative position.

When the connecting rod 116 has been moved beyond the dead point of the toggle mechanism of the torsion coil spring 144, the biasing direction of the spring 144 is reversed. At this moment, the connecting rod 116 is further moved by the coil spring 144, independently of the pivotal movement of the pivot arm 126, whereby the arm portion 46 of the image reading portion 40 comes into abutment with the stopper pin 80. In this manner, the image-reading portion 48 and the checking member 90 are located into their reading and operative positions, respectively, as indicated in solid line in FIG. 7. Meanwhile, the first limit switch 148 is actuated by the corresponding end of the connecting rod 116, whereby the drive motor 75 is deenergized. In this condition, beams of light are emitted from the light-emitting elements LE1–LE13, and transmitted through the light-emitting optical fibers T1–T13 from their second ends to their first ends at the image-reading portion 48. Thus, the beams of light are radiated toward the reflector surface 96. The beams of light reflected by the reflector surface 96 are received by the light-receiving optical fibers R1–R12 and transmitted therethrough to the corresponding light-sensitive elements LS1–LS4. In response to the intensity of the light beams received, the light-sensitive elements LS1–LS4 generate signals, which are used for checking the optical sensitivity of the image reading device 11. Since the method of checking the optical sensitivity based on these signals is not essential to the understanding of the present invention, no further description is provided herein. Details of such a checking method are described in Japanese Patent Application No. 58-151797.

In reading images recorded on the sheet of paper 3 on the platen 2, the image-reading portion 48 of the image reading device 40 is located at its operative position adjacent to the platen 2, as indicated in solid line in FIG. 3. The carriage 16 and the image reading device 40 mounted thereon are slidably moved on the guide rod 12 (and the guide rail 14) along the platen 2, by the drive motor 30 via the timing belt 38 and the other components previously described. As the image reading device 40 is thus moved along the platen 2 relative to the sheet of paper 3, the images on the sheet of paper 3 are read by the image-reading portion 48. In an image reading operation, the beams of light are radiated toward the surface of the sheet of paper 3, and the light beams reflected by the individual reading spots on the paper 3 are received by the respective light-sensitive elements LS1–LS4, which generate signals to be applied to a suitable controller via the amplifiers A1–A4. The controller judges whether a particular reading spot on the paper 3 includes a portion of an image or not. Details of the reading operation are described in pending U.S. Application Ser. No. 726,314 filed Apr. 24, 1985, which was owned by the assignee of the present application.

Since the support portions 42*a*, 42*b* of the image reading device 40 are spaced from each other along the guide rod 12, by a relatively large distance which is greater than the width of the carriage 16, the image reading device 40 is protected from its rotational displacement about an axis perpendicular to the guide rod 12, and relative to the platen 2 in the directions toward and away from the surface of the platen 2. As a result, the image-reading portion 48 can be accurately positioned relative to the sheet of paper 3 on the platen 2, which permits improved reading accuracy and reliability.

When a printing on the sheet of paper 3 is achieved after completion of an image reading operation, the drive motor 75 is operated in the reverse direction. As a result, the pivot arm 126 is pivoted clockwise (in FIGS. 6 and 7) through the reduction gear device 130, 132, 134, 136, 138 and 140, and the operating end 128 of the pivot arm 126 is brought into contact with one of the longitudinally opposed inner surfaces of the rectangular hole 120 which is locted nearer to the round hole 118*b*. Then, the connecting rod 116 is moved in such a direction as to cause the image reading device 40 and the checking member 90 to be pivoted counterclockwise and clockwise, by means of the actuator member 70 and the pivotable member 110, from their reading or operative position toward their retracted or inoperative position, respectively. When the connecting rod 116 has been moved beyond the dead point of the coil spring 144, the biasing force of the spring 144 is reversed, and thereafter the connecting rod 116 is further moved by the biasing force of the spring 144 independently of the pivotal movement of the pivot arm 126, until the first arm 104 of the pivotable member 100 has abutted on the stopper 146. Thus, the image-reading portion 48 and the checking member 90 are placed in their retracted and inoperative positions, respectively. In the meantime, the second limit switch 150 is actuated by the corresponding end of the connecting rod 116, and the drive motor 75 is stopped.

Subsequently, the carriage 16 and the image reading device 40 are moved along the platen, while the printing portion 26 effects printing of desired images on the sheet of paper 3 via the ink ribbon 28. Since the image-reading portion 48 is retracted away from the platen 2, the image-reading portion 48 is protected from otherwise possible contamination by ink particles which are removed from the ink ribbon 28 during the printing operation. Further, the reflector surface 96 of the checking member 90 when placed in its inoperative or rest position is covered by the covering member 152, and is thus protected from being soiled with foreign matters. Even if the reflector surface 96 is soiled, the wiper 154 automatically wipes or cleans the reflector surface 96 when the checking member 90 is moved between its inoperative and operative positions.

Since the carriage 16 is disposed between the support portions 42*a*, 42*b* and positioned above the bridging portion 54 of the image reading device 40, it is possible to save a space required for the carriage 16 and the image reading device 40. Further, the above support arrangement eliminates a structure for connecting the carriage 16 and the image reading device 40 to move them as a unit.

Figure 8:
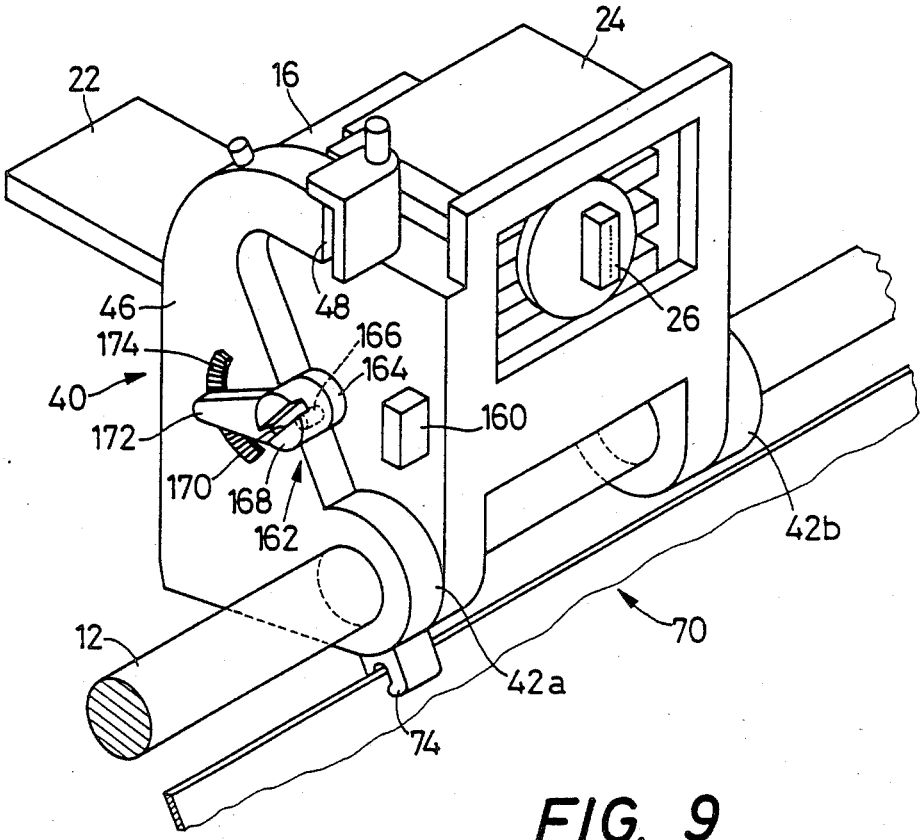
FIG. 8 is a fragmentary perspective view, corresponding to FIG. 3, showing a modified embodiment of the invention.

Referring next to FIG. 8, there is shown another embodiment of a printing apparatus of the present invention, which is different from the preceding embodiment in that the stopper pin 80 of FIG. 3 used in the preceding embodiment is replaced by a stopper lug 160 fixed to the right side surface of the carriage 16, and an adjustable abutment member 162 which is disposed on the arm portion 46 of the image reading device 10 such that the abutment member 162 is abutable on the stopper lug 160. The adjustable abutment member 162 is an eccentric member which comprises: a mounting 164 secured to the arm portion 46; a support pin 166 extending from the mounting 164 parallel to the guide rod 12; a cylindrical member 168 which is supported on the support pin 166 rotatably about the axis of the latter in eccentric relation with each other, and which has a groove 170 for engagement of a screw driver; and an operating portion 172 extending from the cylindrical member 168 in the radial direction of the latter. The eccentric abutment member 162 is positioned so that the outer cylindrical surface of the cylindrical member 168 is abutable on the stopper lug 160, to determine the reading position of the image-reading portion 48. On the right side surface of the arm portion 46, there is disposed an arcuate serration 174 which consists of a plurality of successive teeth. The operating portion 172 of the abutment member 162 resiliently engages the serration 174 at a selected position, whereby a free rotation of the abutment member 162 is prevented. The reading position of the image-reading portion 48 is adjustable by rotating the cylindrical member 168 eccentrically about the support pin 166, with the operating portion 172 or with a suitable screw driver engaging the groove 170.

Thus, the reading position of the image-reading portion 48 of the image reading device 40 is determined through abutting engagement of the abutment member 162 with the stopper lug 160, and a gap between the image-reading portion 48 and the sheet of paper 3 on the platen 2 can be maintained at a desired value. In addition, the reading position, i.e., the above-indicated gap can be readily adjusted by eccentric rotation of the cylindrical member 168 relative to the support pin 166.

Figure 9:
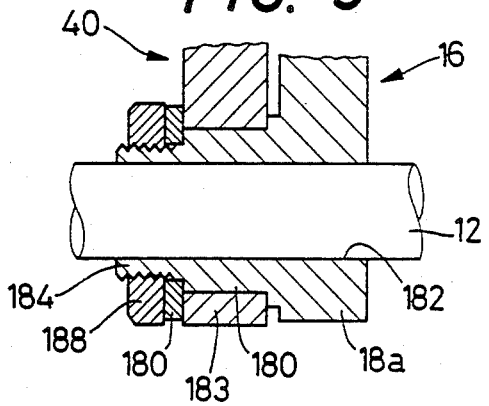
FIG. 9 is a fragmentary cross sectional view illustrating a modified support structure for a carriage and an image reading device of a further embodiment of the invention.

In the previously illustrated embodiments, the carriage 16 and the image reading device 40 are directly mounted on the guide rod 12 so that they are slidably movable as a unit on the guide rod 12 and so that the image reading device 40 is pivotable about the axis of the guide rod 12 relative to the carriage 16. However, it is possible to modify this arrangement. For example, the carriage 16 and the image reading device 40 may be assembled with respect to the guide rod 12, as shown in FIG. 9. In this modified arrangement, the carriage 16 has a sleeve portion 180 which extends from the support portion 18*a* toward the support portion 44*a* of the image reading device 40, parallel to the guide rod 12. The sleeve portion 180 cooperates with the corresponding support portion 20*a* to define a bore 182 through which the guide rod 12 extends, as shown in FIG. 9. A support portion 183 of the image reading device 40 slidably fits on the outer surface of the sleeve portion 180 of the carriage 16, so that the image reading device 40 is pivotally supported on the sleeve portion 180. The sleeve portion 180 has an externally threaded end portion 184. The image reading device 40 is held in place by a spacer 184 which is retained by a nut 186 threaded on the externally threaded end portion 184 of the sleeve portion 180.

The above arrangement may be modified such that the image reading device 40 is formed with a sleeve portion on which the support portion 18 of the carriage 16 is pivotally supported. Further, it is possible that the image reading device 40 is supported pivotally about an axis which is not the axis of the guide rod 12. It is also possible that the image reading device 40 is mounted on the carriage 16 so that the device 40 is linearly slidable thereon between its reading and retracted positions.

Figure 10:
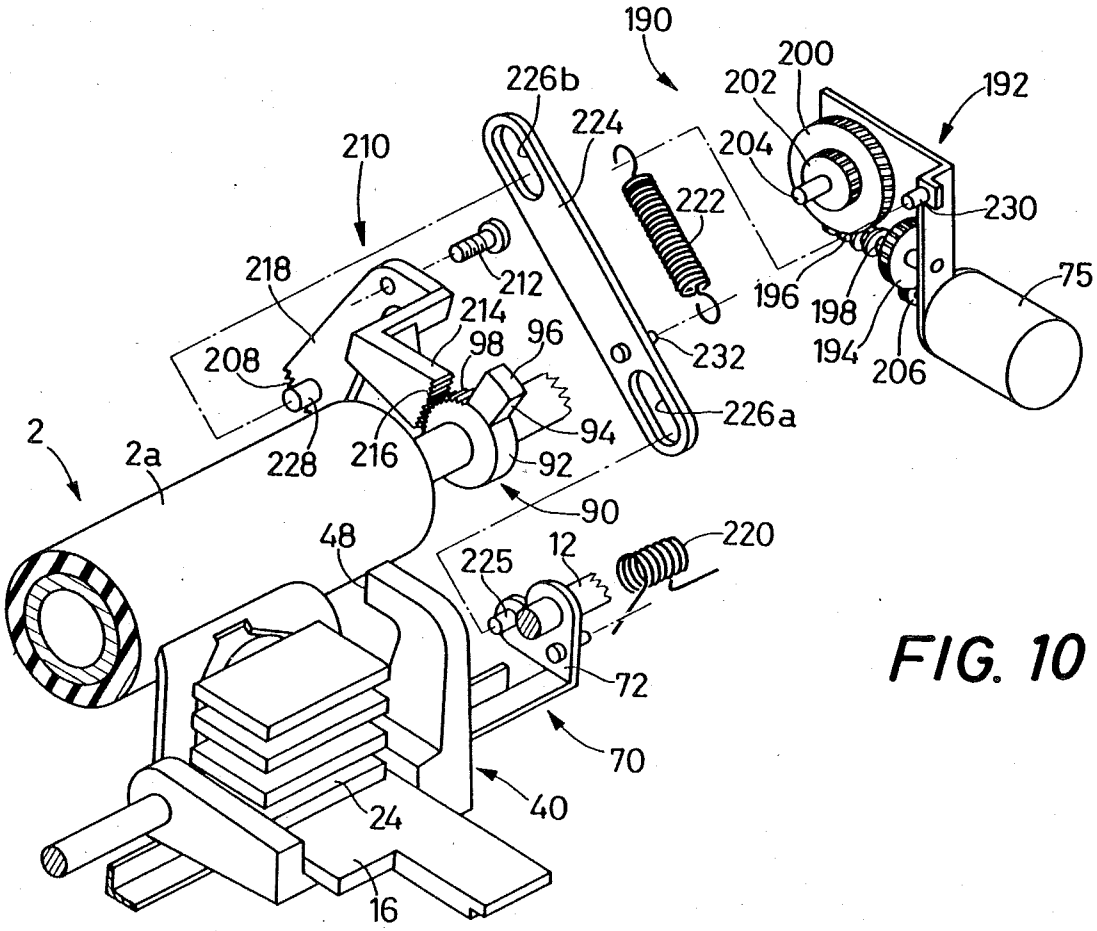
FIG. 10 is a view corresponding to FIG. 6, showing a modified arrangement for checking the image reading device for its sensitivity.

Referring next to FIG. 10, there is illustrated a further embodiment of the invention incorporating a modified linkage arrangement 190 for operating the actuator member 70 (image reading device 40) and the checking member 90. The modified linkage 190 replaces the linkage 114 shown in FIG. 6.

In this modified embodiment of FIG. 10, the drive motor 75 is attached to a bracket 192 which is fixed to the frame 4. The bracket 192 rotatably supports a first gear 194 and a worm 196 on a first shaft 198, and a second and a third gear 200, 202 on a second shaft 204. The first gear 194 meshes with a gear 206 fixed to an output shaft of the drive motor 75, and the worm 196 rotating with the first gear 194 meshes with the second gear 200. The third gear 202 rotating with the second gear 200 meshes with teeth 208 formed on a pivotable member 210. More specifically, the pivotable member 210 is supported pivotally by a pivot pin 212 fixed to the frame 4. The pivotable member 210 includes a first arm 214 with teeth 216 which engages the teeth 98 on the checking member 90, and further includes a second arm 218 which has the teeth 208 engaging the third gear 202. In this arrangement, the pivotable member 210 is pivoted by the drive motor 75 via the gears 206, 194, worm 196, gears 200, 202, and teeth 208. Thus, the checking member 90 is pivoted by the drive motor 75, between its operative and inoperative positions previously described.

In the meantime, the actuator member 70 is biased by a first coil spring 220 in a direction that will cause the image reading device 40 to move to its reading position. However, the image reading device 40 is normally held in its retracted position by a biasing force of a second coil spring 222 which is greater than the biasing force of the first spring 220. Stated in detail, the biasing force of the second coil spring 222 is imparted to the actuator member 70 via a connecting rod 224 and a pin 225 fixed to the support portion 72 of the actuator member 70. The connecting rod 224 has a pair of elongate holes 226*a*, 226*b* at opposite ends, so that the pin 225 engages the elongate hole 226*a*, while a pin 228 fixed to the second arm 218 of the pivotable member 210 engages the other elongate hole 226*b*. The second coil spring 222 is connected at one end to a pin 230 fixed to the bracket 192, and at the other end to a pin 232 fixed to the connecting rod 224, so that the connecting rod 224 is biased toward the pin 228 on the pivotable member 210, whereby the actuator member 70 is normally held a position corresponding to the retracted position of the image reading device 40, against the biasing force of the first coil spring 220.

With the drive motor 75 operated in the appropriate direction, the pivotable member 210 is pivoted in a direction that will cause the pin 228 to push the connecting rod 224 against the biasing force of the second spring 222, in a direction toward the pin 225 on the actuator member 70. As a result, the biasing force of the second spring 222 is removed from the actuator member 70, and therefore the actuator member 70 is allowed to be pivoted by the first spring 220 so as to move the image reading device 40 to its reading position.

While the present invention has been described in its preferred embodiments, it is to be understood that the invention is not confined to the precise details of the illustrated embodiments, but may be otherwise embodied.

For example, it is possible to form the image reading device such that its bridging portion 54 extends over the carriage 16. In this case, the control assembly 56 may preferably disposed on the upper surface of the bridging portion.

While the adjustable abutment pin 162 of FIG. 8 is constructed such that the cylindrical member 168 is rotatable eccentrically on the outer cylindrical surface of the support pin 166, it is possible that the cylindrical member 168 has an integral cylindrical extension parallel to the guide rod 12, which extension is eccentric with the cylindrical surface of the cylindrical member 168 and is rotatably supported in a bore formed in the mounting 164.

In the illustrated first embodiment, the drive motor 75 is used to move the checking member 90 the image reading device 40 between two positions. The drive source for operating the checking member 90 and the image reading device 40, however, may be replaced by other suitable means such as a solenoid.

Further, the reading position of the image-reading portion 48 may be selected below a path of the ink ribbon 28.

Although the image reading device 40 of the illustrated embodiments of the invention uses the optical fibers T1–T13 and R1–R12, the light-emitting elements LE1–LE13, and the light-sensitive elements LS1–LS4, it is possible to use other types of image reading sensors such as charge-coupled devices (CCD) or other solid-state image sensors.

It will be obvious to those skilled in the art that other changes, modifications and improvements may be made in the invention, without departing from the spirit and scope of the invention defined in the appended claims.

What is claimed is:

1. A printing apparatus with an image reading function, comprising:

an elongated platen for supporting a recording medium;

a guide rod having a circular shape in transverse cross section and extending parallel to said platen;

a carriage slidably movable on said guide rod;

a printing head mounted on said carriage;

an image reading device slidably movable on said guide rod in an axial direction of the guide rod, and slidably pivotable on and about said guide rod, said image reading device including an image-reading portion provided at a position away from an axis of said guide rod, for reading images on the recording medium, said image reading portion being pivotable about said guide rod between a reading position adjacent the recording medium, and a retracted position spaced from said reading position in a direction away from the recording medium; and connecting means for connecting said image reading device to said carriage so as to permit said image reading device to move together with said carriage.

2. A printing apparatus with an image reading function, comprising:

an elongated platen for supporting a recording medium;

an elongate guide member extending parallel to said platen;

a carriage slidably movable on said guide member and having a lug fixed thereto;

a printing head mounted on said carriage;

an image reading device including an image-reading portion for reading images on the recording medium, said image-reading portion being movable between a reading position adjacent the recording medium, and a retracted position spaced from said reading position in a direction away from the recording medium; and connecting means for connecting said image reading device to said carrige so as to permit said image reading device to move together with said carriage, said image reading device further including an eccentric abutment member including a first outer cylindrical surface abutable on said lug to thereby determine said reading position of said image-reading portion, a second cylindrical surface eccentric with respect to said first outer cylindrical surface, and an operating portion extending in a radial direction of the eccentric emmber, said abutment member being supported on said image reading device rotatably about a centerline of said second cylindrical surface, said image reading device further including a serrated part, said operating portion of said abutment member resiliently engaging said serrated part of the image reading device, so as to prevent a free rotation of the abutment member.

3. A printing apparatus as set forth in claim 1, wherein an ink ribbon is passed along said platen and between said printing head and said recording medium so that the printing head effects a printing operation on the recording medium through said ink ribbon, said image-reading portion of the image reading device being located away from a part of the recording medium corresponding to a path of said ink ribbon.

4. A printing apparatus with an image reading function, comprising:

an elongated platen for supporting a recording medium;

an elongate guide member extending parallel to said platen;

a carriage slidably movable on said guide member and having a stopper fixed thereto;

a printing head mounted on said carriage;

an image reading device including an image-reading portion for reading images on the recording medium, said image reading portion being movable between a reading position adjacent the recording medium, and a retracted position spaced from said reading position in a direction away from the recording medium, said image reading device being abutable on said stopper, thereby determining said reading position of said image reading portion thereof; and connecting means for connecting said image reading device to said carriage such that said image reading device moves together with said carriage.

5. A printing apparatus as set forth in claim 4, wherein said stopper consists of a pin which is fixed to said carriage and which extends parallel to said guide member.

6. A printing apparatus as set forth in claim 5, wherein said pin comprises a shaft portion rotatably supprted at one end thereof by said carriage, a head portion which is secured to the other end of said shaft portion in eccentric relation with each other and is abutable with said image-reading portion, and an operating portion for rotating said pin about an axis of said shaft portion, whereby said reading position of said image-reading portion is adjustable by rotation of said pin.

7. A printing apparatus as set forth in claim 4, wherein said stopper consists of a lug fixed to said carriage, and said image reading device has an adjustable abutment member which is abutable on said lug to thereby determine said reading position of said image-reading portion.

8. A printing apparatus as set forth in claim 7, wherein said adjustable abutment member consists of an eccentric member including a first outer cylindrical surface abutable on said lug, and a second cylindrical surface eccentric with respect to said first outer cylindrical surface, said eccentric member being supported on said image reading device rotatably about a center-line of said second cylindrical surface.

9. An image reading apparatus comprising:

an elongate platen including a paper support portion for supporting the recording medium;

an elongate guide member extending parallel to said platen;

a carriage slidably movable on said guide member;

an image reading device including an image-reading portion for reading images on the recording medium on said platen, said image-reading portion being movable between a reading position adjacent to the recording medium, and a retracted position spaced from said reading position in a direction away from the recording medium;

connecting means for engagement of said image reading device with said carriage, to permit said image reading device to move together with said carriage in the same direction by the same amount;

an optical-sensitivity checking member for checking for the image reading device for its optical sensitivity, said checking member having a reflector surface located away from one of opposite longitudinal ends of said paper support portion of the platen, said checking member being movable between an operative position at which said reflector surface is positioned opposite to said image-reading portion in said reading position, and an inoperative position at which said reflector surface is misaligned with said image-reading portion in said reading position; and a linkage for operatively connecting said checking member and said image reading device to a common drive source, said linkage causing said checking member to be moved to said operative position and said inoperative position when said image-reading portion is moved by said common drive source to said reading position and said retracted position, respectively.

10. A printing apparatus with an image reading function, comprising:

an elongated platen, including a paper support portion, for supporting a recording medium;

an elongate guide member extending parallel to said platen;

a carriage slidably movable on said guide member;

a printing head mounted on said carriage;

an image reading device including an image-reading portion for reading images on the recording medium, said image-reading portion being movable between a recording position adjacent the recording medium, and a retracted position spaced from said reading position in a direction away from the recording medium, connecting means for connecting said image reading device to said carriage so as to permit said image reading device to move together with said carriage;

an optical sensitivity checking member for checking the optical sensitivity of the image reading device, said checking member having a reflector surface located away from a longitudinal end of said paper support portion of the platen, said checking member being movable between an operative position at which said reflector surface is positioned opposite to said image-reading portion in said reading position, and an inoperative position at which said reflector surface is not aligned with said image-reading portion in said reading position; and a linkage for operatively connecting said checking member and said image reading device to a common drive source, said linkage causing said checking member to be moved to said operative position and said inoperative position when said image-reading portion is moved by said common drive source to said reading position and said retracted position, respectively.

11. A printing apparatus as set forth in claim 10, further comprising a stationary covering member for covering said reflector surface of said checking member in said inoperative position.

12. A printing apparatus as set forth in claim 11, wherein said covering member has a wiper disposed on a surface thereof opposite to said reflector surface, to clean the reflector surface during movements of said checking member between said operative and inoperative positions.

13. A printing apparatus as set forth in claim 10, wherein said elongate guide member comprises a guide rod having a circular shape in transverse cross section, said image reading device being supported by said guide rod pivotally about an axis of the guide rod, said elongate platen further including a shaft portion at which the platen is rotatably supported, said checking member being supported by said shaft portion of the platen pivotally about said shaft portion.

14. A printing apparatus as set forth in claim 13, wherein said linkage comprises:

an actuator member including an elongate operating portion which extends along said guide rod, and a pair of support portions which extend from opposite ends of said operating portion substantially perpendicularly to said operating portion, said actuator member being supported at said support portions thereof by said guide rod pivotally about the guide rod, said elongate operating portion slidably engaging said image reading device so as to permit the image reading device to move relative to said operating operation along said guide rod;

a connecting rod operatively connecting said actuator member and said checking member, said connecting rod being movable between a first position at which said image-reading portion of the image reading device and said checking member are placed in said reading and operative positions, respectively, and a second position at which said image-reading portion and said checking member are placed in said retracted and inoperative positions, respectively;

a pivot arm which is pivoted by said drive source within a predetermined angular range about an axis parallel to the axis of said guide rod, said pivot arm having a free end which engages said connecting rod with a clearance therebetween; and biasing means for biasing said connecting rod toward said first and second positions when the connecting rod have been pivoted, by said pivot arm, to positions near said first and second positions, respectively, whereby said image-reading portion and said checking member are biased by said biasing means toward said reading and operative positions, and toward said retracted and inoperative positions, respectively.

15. A printing apparatus as set forth in claim 13, wherein said linkage comprises:

an actuator member including an elongate operating portion which extends along said guide rod, and a pair of support portions which extend from opposite ends of said operating portion substantially perpendicularly to said operating portion, said actuator member being supported at said support portions thereof by said guide rod pivotally about the guide rod, said elongate operating portion slidably engaging said image reading device so as to permit the image reading device to move relative to said operating operation along said guide rod;

a first spring for biasing said actuator member toward a first position thereof corresponding to said image reading position;

a second spring providing a biasing force greater than that of said first spring;

a connecting rod operatively connected to said actuator member so as to exert the biasing force of said second spring to said actuator member to normally hold the actuator member in a second position thereof corresponding to said retracted position, against the biasing force of said first spring, said connecting rod being operatively connected to said checking member so that the movement of said checking member from its inoperative position to its operative position is imparted to said connecting rod to move the connecting rod against the biasing force of said second spring, and to thereby allow said actuator member to be moved from its second position to its first position by the biasing force of said first spring; and means for transmitting a drive force of said drive source to said checking member to move the checking member between its operative and inoperative positions.

* * * * *